US006070560A

United States Patent [19]

Johnston et al.

[11] Patent Number: 6,070,560

[45] Date of Patent: Jun. 6, 2000

[54] COOLING FAN SYSTEM FOR A MOTOR VEHICLE

[75] Inventors: Stephen Johnston, Redford; Kevin J. Laboe, Birmingham, both of Mich.

[73] Assignee: DaimlerChrylser Corporation, Auburn Hills, Mich.

[21] Appl. No.: 09/185,694

[22] Filed: Nov. 4, 1998

[51] Int. Cl.[7] ..... F01P 7/02

[52] U.S. Cl. ..... 123/41.11; 123/41.12; 123/41.49; 165/51

[58] Field of Search ..... 123/41.11, 41.12, 123/41.49; 165/41, 51

[56] References Cited

U.S. PATENT DOCUMENTS

| | | | |
|---|---|---|---|
| 4,134,484 | 1/1979 | Lasinger . | |
| 4,278,159 | 7/1981 | Roth et al. . | |
| 4,320,723 | 3/1982 | Wendling et al. | 123/41.12 |
| 4,797,600 | 1/1989 | Savage et al. | 123/41.49 |
| 5,180,003 | 1/1993 | Kouzel et al. | 123/41.49 |

FOREIGN PATENT DOCUMENTS

| | | | |
|---|---|---|---|
| 3432 439 | 8/1995 | Germany | 123/41.49 |
| 3432-439 | 8/1995 | Germany | 123/41.49 |
| 1574-859 | 6/1990 | U.S.S.R. | 123/41.49 |

*Primary Examiner*—Erick Solis
*Assistant Examiner*—Brian Hairston
*Attorney, Agent, or Firm*—Marc Lorelli

[57] ABSTRACT

A cooling fan system includes an engine driven mechanical fan and an electrically driven fan. The mechanical fan and the electrical fans are placed in series within a common shroud that directs air between them. In one application, the electrical fan generates an axially directed air flow and the mechanical fan produces a radially directed air flow. The electrical fan is rotated counter to the mechanical fan.

18 Claims, 6 Drawing Sheets

COOLING FAN SYSTEM FOR A MOTOR VEHICLE

BACKGROUND OF THE INVENTION

1. Technical Field

The present invention generally pertains to motor vehicles. More particular, the present invention pertains to a cooling fan system for a motor vehicle. More specifically, but without restriction to the particular embodiment and/or use which is shown and described for purposes of illustration, the present invention relates to a cooling fan system of a motor vehicle which incorporates a mechanical fan which rotates in a first direction and an electrical fan which rotates in a second, counter direction.

2. Discussion

Modern motor vehicles incorporate a fan, often referred to as an engine cooling fan or radiator fan, for cooling the engine. Such fans are typically engine driven. Engine cooling studies conducted on passenger cars and trucks have shown that operation of such engine cooling fans is required only a fraction of the time a vehicle is on the road. If the fan is run at a high speed when generally not required, additional fuel may be unnecessarily consumed and the noise produced may be objectionable. For these reasons, various arrangements have been heretofore developed to reduce the high speed operation of the mechanically driven fans as well as to control the operation in an effort to reduce the total energy required for operating the fan.

In one common type of arrangement, viscous couplings have been employed for engaging and disengaging the fan. These viscous couplings typically rely on the drive force created by fluid shear which occurs between two members having mating annular grooves and ridges or mating surfaces. The fan speed is dependent upon the speed of the driving element and the amount of working fluid in the mating grooves and ridges or between the operating surfaces. When the grooves are only partially filled, considerable slip occurs between the two members and the fan speed is considerably less than the speed of the driving member. When the space between the grooves and the ridges is completely filled with fluid, slip above a first predetermined engine speed would be reduced. When the speed of the driving element rise above a second predetermined value, the viscosity and shear characteristics are such that an increased amount of slippage occurs to prevent substantial increase in fan speed. Particular cooling fan arrangements incorporating viscous couplings are shown and described in commonly assigned U.S. Pat. Nos. 4,134,484 and 4,278,159. U.S. Pat. Nos. 4,134,484 and 4,278,159 are hereby incorporated by reference as if fully set forth herein.

To a more limited extent, it has been heretofore proposed to provide a cooling system for a motor vehicle which incorporates an electrical fan which is supplemented by a mechanical fan. For example, the cooling system of the 1996 Ford Crown Victoria includes an electrically driven fan driven by a single speed fan motor and a mechanically driven fan driven through a clutch. A temperature-controlled fluid coupling regulates the speed of the mechanically driven fan according to the temperature of air coming through the radiator core and flowing around a bi-metal control valve located on a forward face of the fan clutch.

While certain advantages may have been provided by prior art arrangements, including but not limited to those discussed above, they are all associated with disadvantages. For example, known cooling arrangements incorporating a mechanical fan driven through a clutch require a moderate to high engine speed for cooling fan disengagement. Typically, the disengage speed for an engine driven fan is approximately 1500 revolutions per minute (RPM) when the vehicle is operating at a road speed of 60 miles per hour (MPH). As the vehicle speed increases, the disengage speed for the engine driven fan increases in some proportional amount. The disengage speed for some engine driven fans can exceed 2800 engine RPM.

In such known arrangements, the moderate to high disengage speed is required to maintain the desired engine cooling temperatures and air conditioning compressor pressures. It is also a factor in enabling a linear modulating fan drive to perform properly. However, it is readily apparent to those skilled in the art that reduction in fan power requirements translates to vehicle fuel savings and horsepower gain.

SUMMARY OF THE INVENTION

It is a general object of the present invention to provide a cooling fan system for a motor vehicle which overcomes the disadvantages associated with prior known arrangements by reducing the engine speed at which disengagement of an engine driven cooling fan occurs.

It is a related object of the present invention to provide a cooling fan system which contributes to vehicle fuel savings and horsepower gain.

It is another object of the present invention to provide a cooling fan system which reduces fan noise, increases trailer towing capacity and improves air conditioning performance.

Briefly, in one form the present invention provides a cooling fan system for a motor vehicle having an engine and a radiator. The cooling fan system includes a first fan and a second fan. The first fan is adapted to be disposed between the engine and the radiator. The first fan is adapted to rotate in a first direction. The second fan is disposed in series with said first fan and adapted to rotate in a second direction. The second direction is counter to the first direction.

In a more preferred form, the cooling fan system of the present invention includes an electrically driven fan and a mechanically driven fan. The fans are disposed in series between the engine and the radiator. The electrically driven fan rotates in a first direction. The mechanically driven fan rotates in a second, counter direction.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
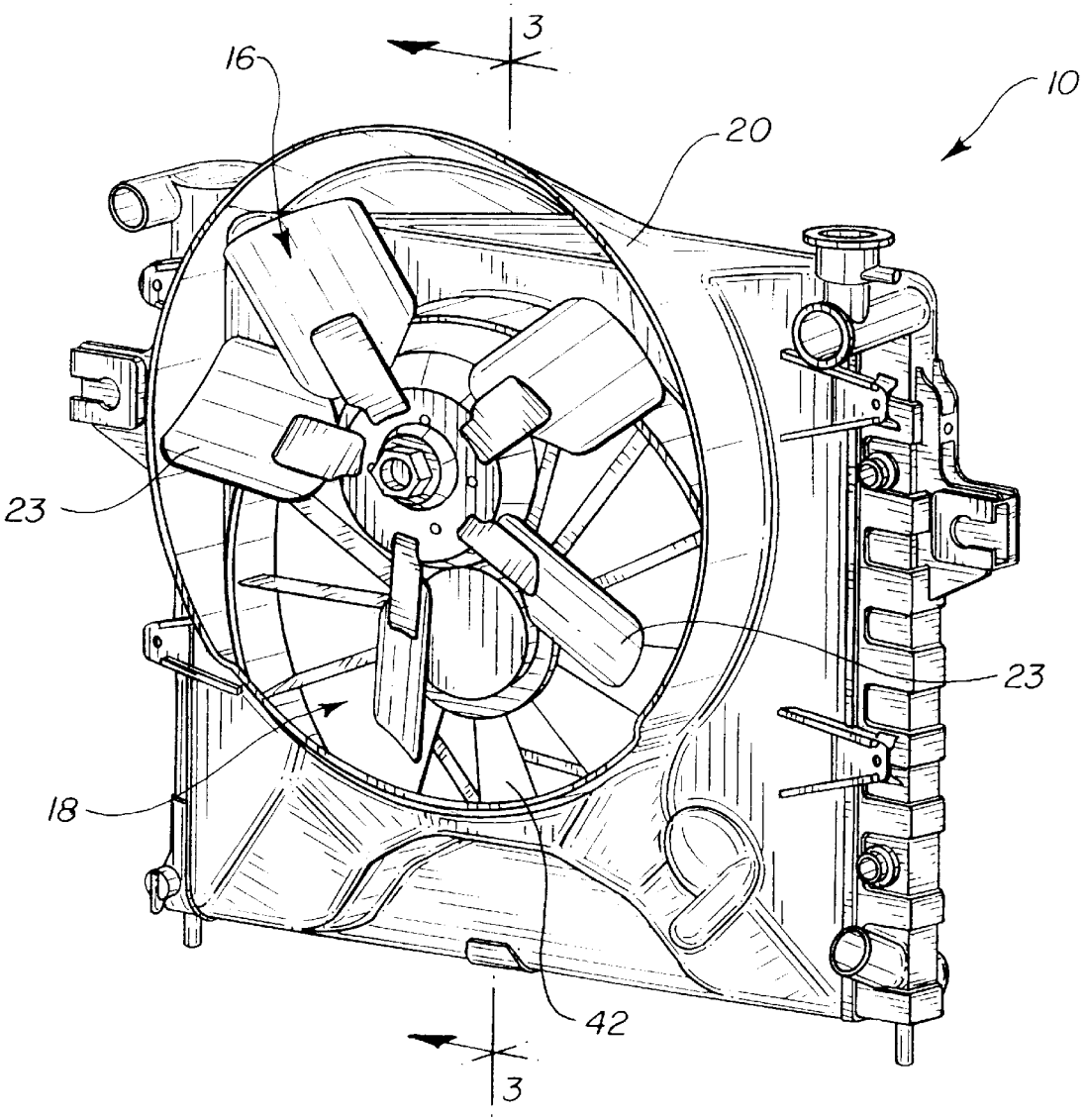
FIG. 1 is a rear perspective view of a cooling fan system constructed in accordance with the teachings of a preferred embodiment of the present invention.
Figure 2:
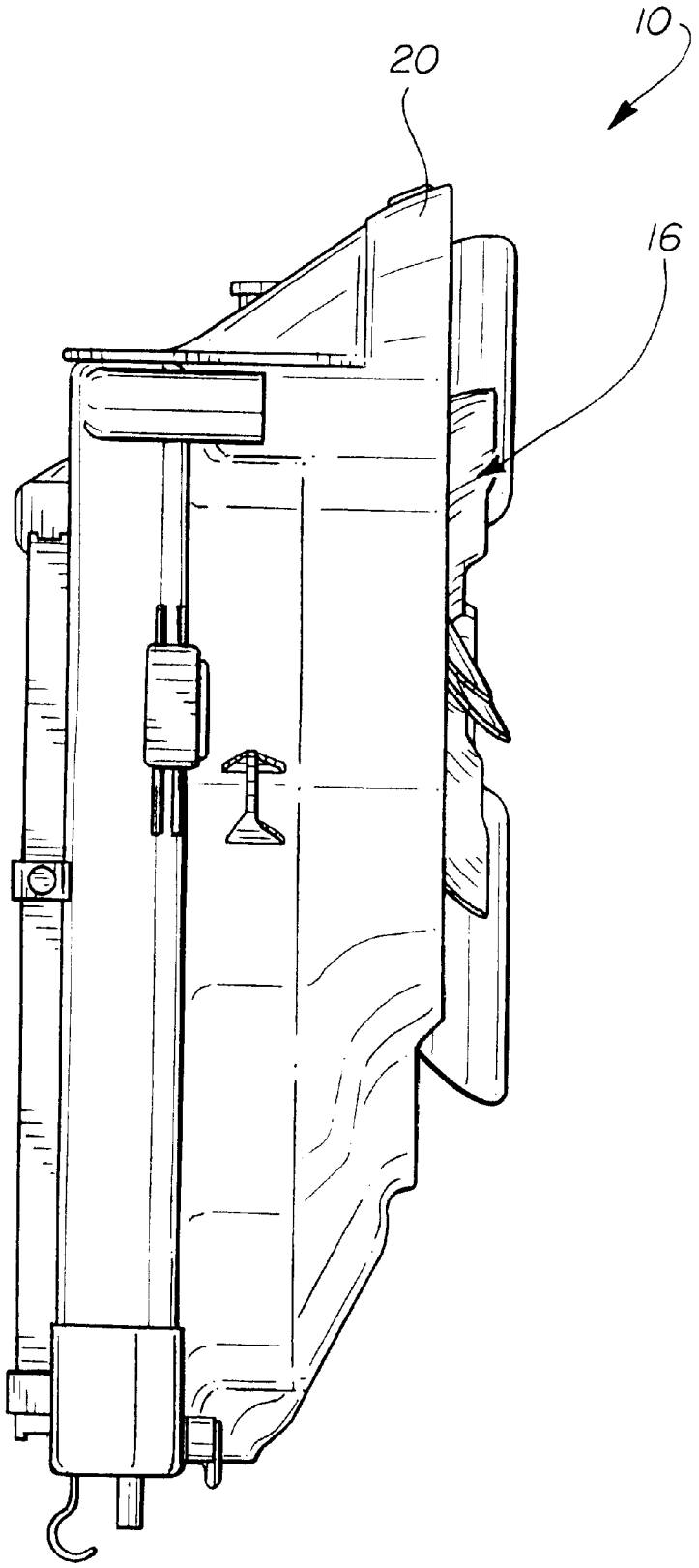
FIG. 2 is a side view of the cooling fan system of the present invention.
Figure 3:
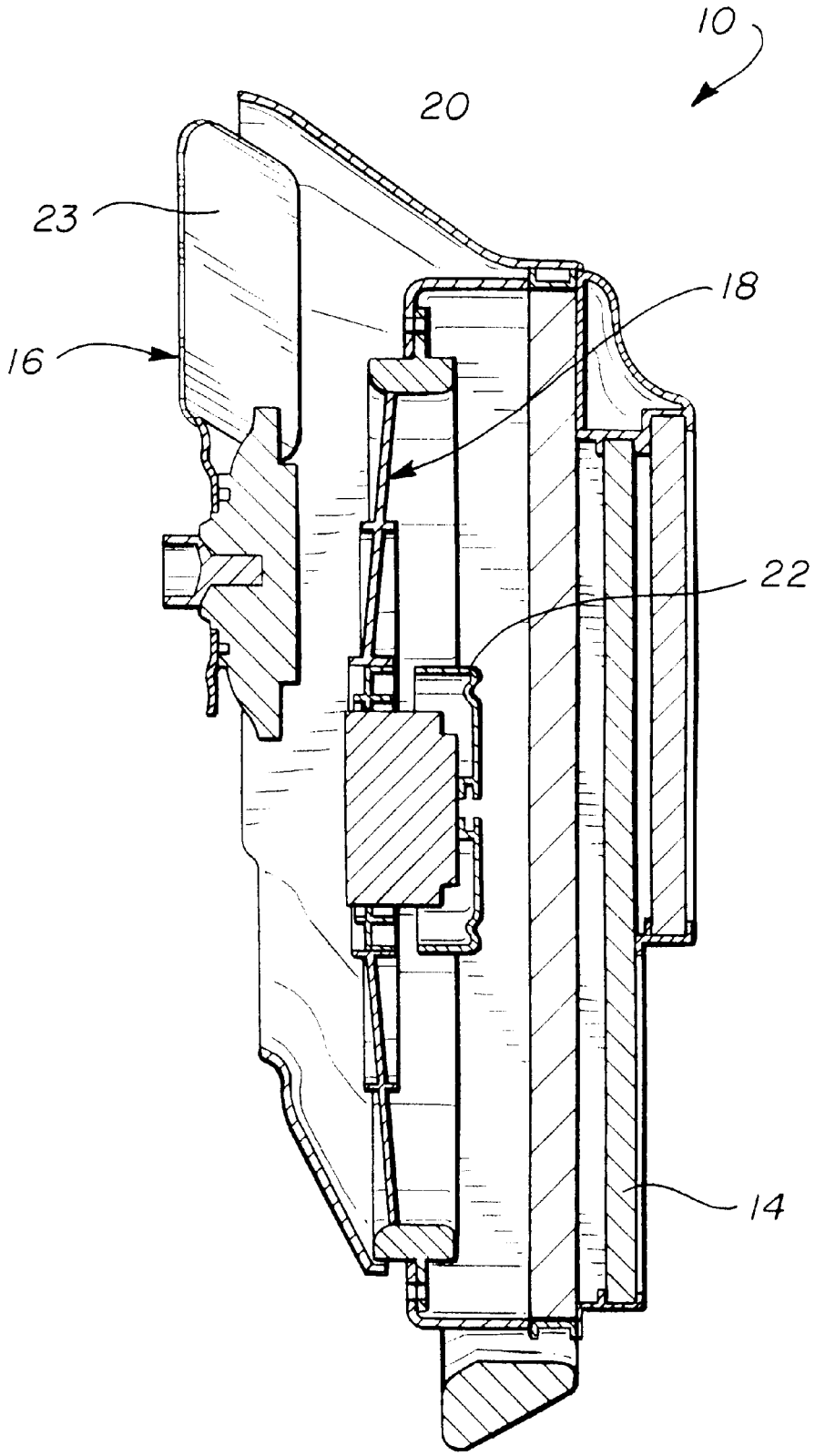
FIG. 3 is a simplified cross-sectional view taken along the line 3–3 of FIG. 1.

With initial reference to FIGS. 1 through 4 of the drawings, a cooling fan system for a motor vehicle constructed in accordance with the teachings of a preferred embodiment of the present invention is illustrated and generally identified with reference numeral 10. As particularly shown in the schematic view of FIG. 4, the cooling fan system 10 is shown operatively mounted between an engine 12 and a radiator 14 of the motor vehicle in a conventional manner. The particular arrangement shown throughout the drawings will be understood to be merely an exemplary representation of the teachings of the present invention. It will be further understood that the teachings of the present invention are applicable for virtually any vehicle incorporating an internal combustion engine.

The cooling fan system is shown to generally include a first fan 16 and a second fan 18 preferably mounted in series within a common fan shroud 20 which directs air between them. The fan shroud 20 is positioned aft of the radiator 14 and secured thereto in a conventional manner. One suitable type of air shroud 20 is shown and described in commonly assigned U.S. Ser. No. 09/132,884, filed Aug. 12, 1998, which is hereby incorporated by reference as if fully set forth herein. However, it will be understood that other shrouds for directing air flow between the fans 16 and 18 may alternatively be employed.

The first fan 16 is preferably a mechanical fan driven by an output (shown in FIG. 4) of the engine 12 through a clutch 22. The mechanical fan 16 is mounted in a generally conventional manner for rotation about an axis A in a first direction, as indicated by arrow B in FIG. 4. In the exemplary embodiment illustrated, the mechanical fan 16 is mounted for rotation in a clockwise direction as viewed from the engine 12. In one application, the mechanical fan 16 is constructed to include five blades 23. The blades 23 of the mechanical fan 16 are preferably configured in a conventional manner so as to generate a radially directed airflow.

Figure 4:
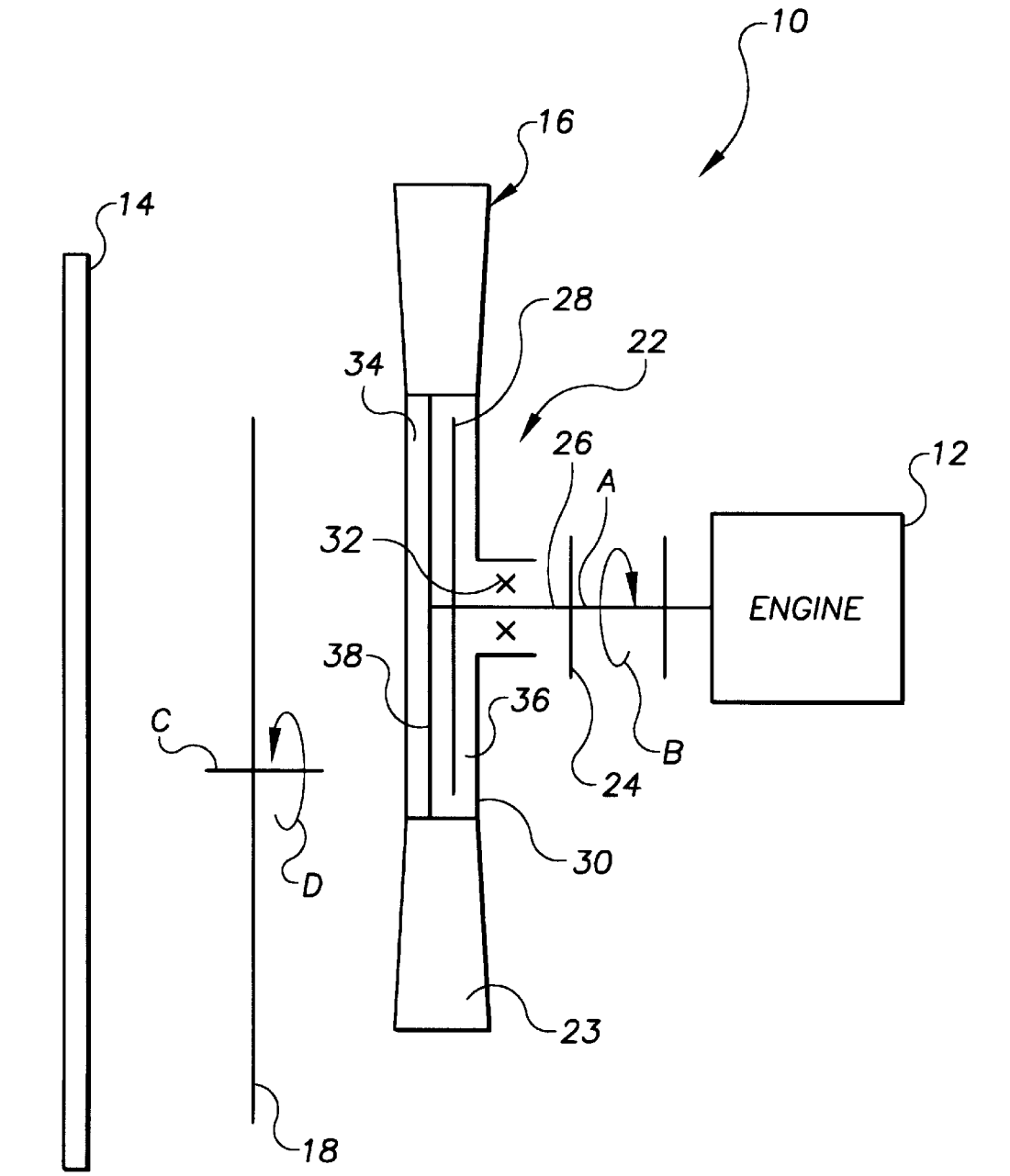
FIG. 4 is a schematic illustrating showing a clutch interconnecting the mechanical fan and the engine.

With particular reference to the schematic representation of FIG. 4, the clutch of the exemplary embodiment is illustrated as a fluid-friction clutch 22 of known construction. The fluid-friction clutch 22 is generally illustrated to include an input flange 24, an input shaft 26 and an input disk 28 secured thereon. A clutch housing 30 is rotatably mounted on the input shaft 26 via a hub by means of ball bearings 32. The housing 30 conventionally comprising a working chamber 34 and a reservoir chamber 36. These chambers 34 and 36 are partitioned off from one another by a dividing wall 38 but are connected to one another in terms of flow by opening or valves (not shown). The torque from the input disk 28 is transmitted by the fluid friction of a viscous medium to the housing 30. The housing 30 carries the mechanical fan 16.

When the speed of the input disk 28 rises above a predetermined value, the viscosity and shear characteristics of the clutch 22 are such that slippage occurs. This slippage will prevent a substantial increase in fan speed or actually decrease fan speed. This aspect of the present invention will be addressed further below.

One suitable fluid-friction clutch 22 is commercially available from Delphi Corporation as Chrysler Corporation part number 52079432AB. However, it will be understood by those skilled in the art that other clutches may be alternatively incorporated into the cooling fan system of the present invention. Such alternative clutches may or may not be viscously controlled.

The second fan 18 of the cooling fan system 10 of the present invention is preferably an electrically driven fan. The electrically driven fan 18 is powered by an electric drive motor (not shown) of conventional construction. As will be appreciated by those skilled in the art, the electrical fan 18 operates with significantly reduced noise as compared to mechanical fans. The electrical fan 18 is preferably mounted for rotation about an axis C in a counterclockwise direction (identified by arrow D in FIG. 4) which is counter to the direction of rotation of mechanical fan 16. In the exemplary embodiment illustrated, the electrical fan 18 is constructed to include five blades 42 which are preferably configured in a conventional manner to generate an axially directed airflow. Further in the preferred embodiment, the axis C is offset from the axis A about which the mechanical fan 16 rotates. The electrical fan 18 functions to create an air system pressure within the shroud 20 which is utilized to create a desired torque upon the mechanical fan 16. This added or reduced torque can be used to control the speed of the mechanical fan 16. Mechanical fan 16, during certain conditions, becomes engaged. The airflow from the electric fan 18 is substantially axial in nature and provides more efficient operation of the mechanical fan 16. The airflow from the electric fan 18 is substantially more axial in nature than airflow coming through a radiator. In the exemplary arrangement, mechanical fan 16 becomes engaged when a bi-metal thermocouple 31 mounted thereon senses temperatures in excess of 200° F. The efficiency of the present invention under such conditions is significantly higher than a standard cooling system efficiency, due in part to the axial airflow imparted on the mechanical fan 16.

The electrical fan 18 of the cooling fan system 10 of the present invention provides idle and low-speed cooling. The mechanical fan 16, when fully engaged, addresses highway and trailer towing requirements. Because the electrical fan 18 operates more quietly than the mechanical fan 16 and may not run at all in cool or moderate temperature conditions, idle and low-speed operation is substantially quieter than systems fully relying upon a mechanical fan.

The cooperating fans 16 and 18 of the present invention provide necessary cooling requirements while allowing for non-continuous operation of the mechanical fan 16. Compared to prior known arrangements, the mechanical fan 16 is adapted to disengage at a significantly lower engine RPM. This is possible since the cooperating fans 16 and 18 provide an improved air flow.

Figure 5:
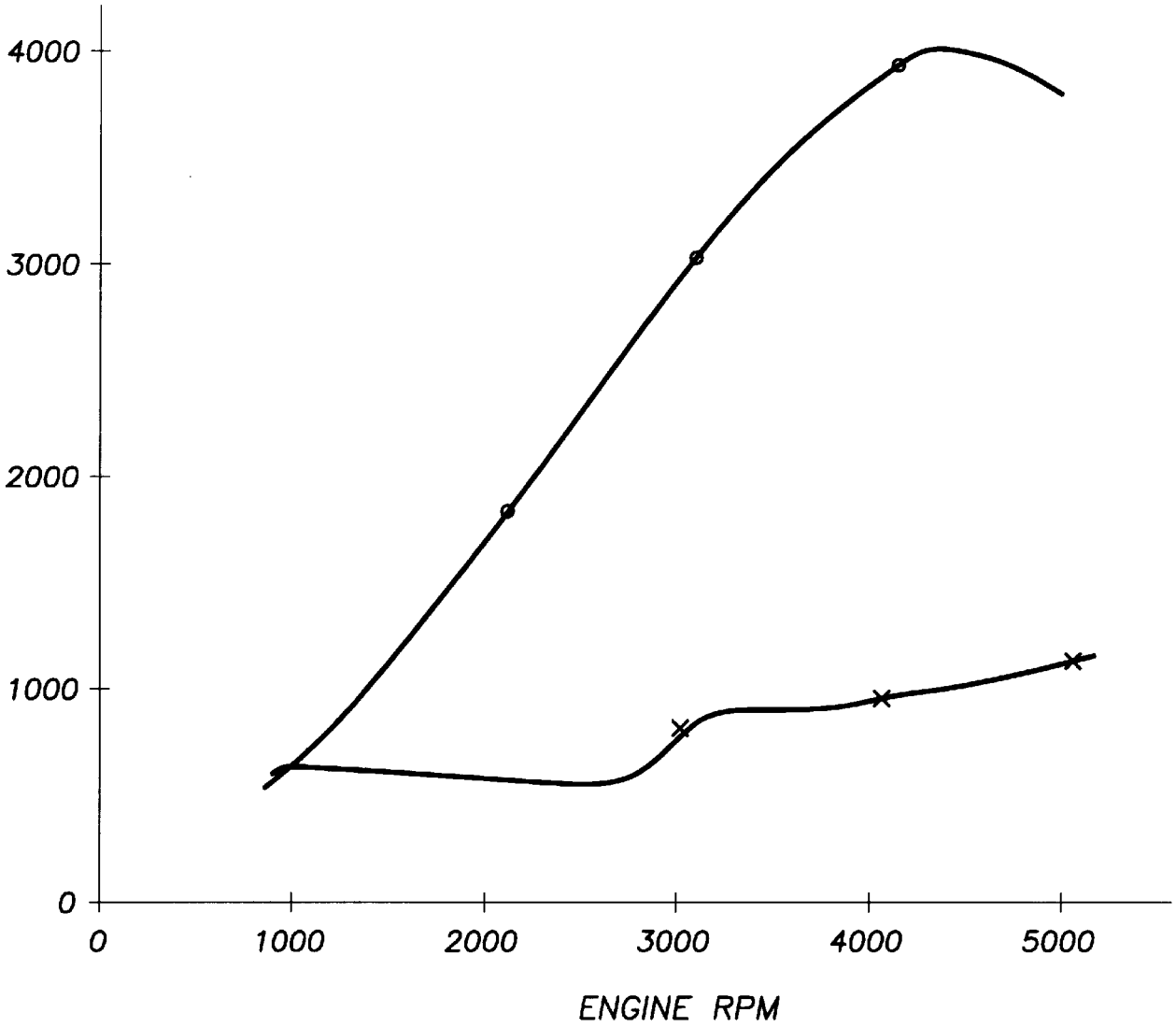
FIG. 5 is a graph illustrating engine RPM versus mechanical fan RPM for the present invention as well as for a typical cooling arrangement.

With particular reference to FIG. 5, engine RPM is graphed versus the minimum RPMs of the mechanical fan 16 for the exemplary arrangement 50 as well as for a standard clutch arrangement 51. In the exemplary arrangement illustrated, the clutch 22 is tuned to allow mechanical fan 16 to operate at substantially slower speeds than the engine when desired, such as when the air temperatures measured by a thermocouple 31 are below a predetermined value. Depending on the cooling load, mechanical fan 16 in the exemplary arrangement may operate in a partial disengaged mode of operation 50 thereby allowing only a minimal power draw from the engine 12. The use of a fluid friction clutch 22 allows for power gain over using a typical clutch as depicted as 52 in FIG. 5 by allowing power to be returned to engine 12. Clutch 22 is capable of operating the mechanical fan 16 in a partial disengaged mode 50 and an engaged mode. With the use of electric fan 18, full engagement of clutch 22 and mechanical fan 16 coupled thereto is only needed during severe cooling conditions, i.e. when thermocouple 31 reads an air temperature higher than a predetermined value of 200° F. When the clutch 22 of the exemplary arrangement is engaged under such severe operating conditions, it behaves essentially like a standard clutch arrangement 51.

Figure 6:
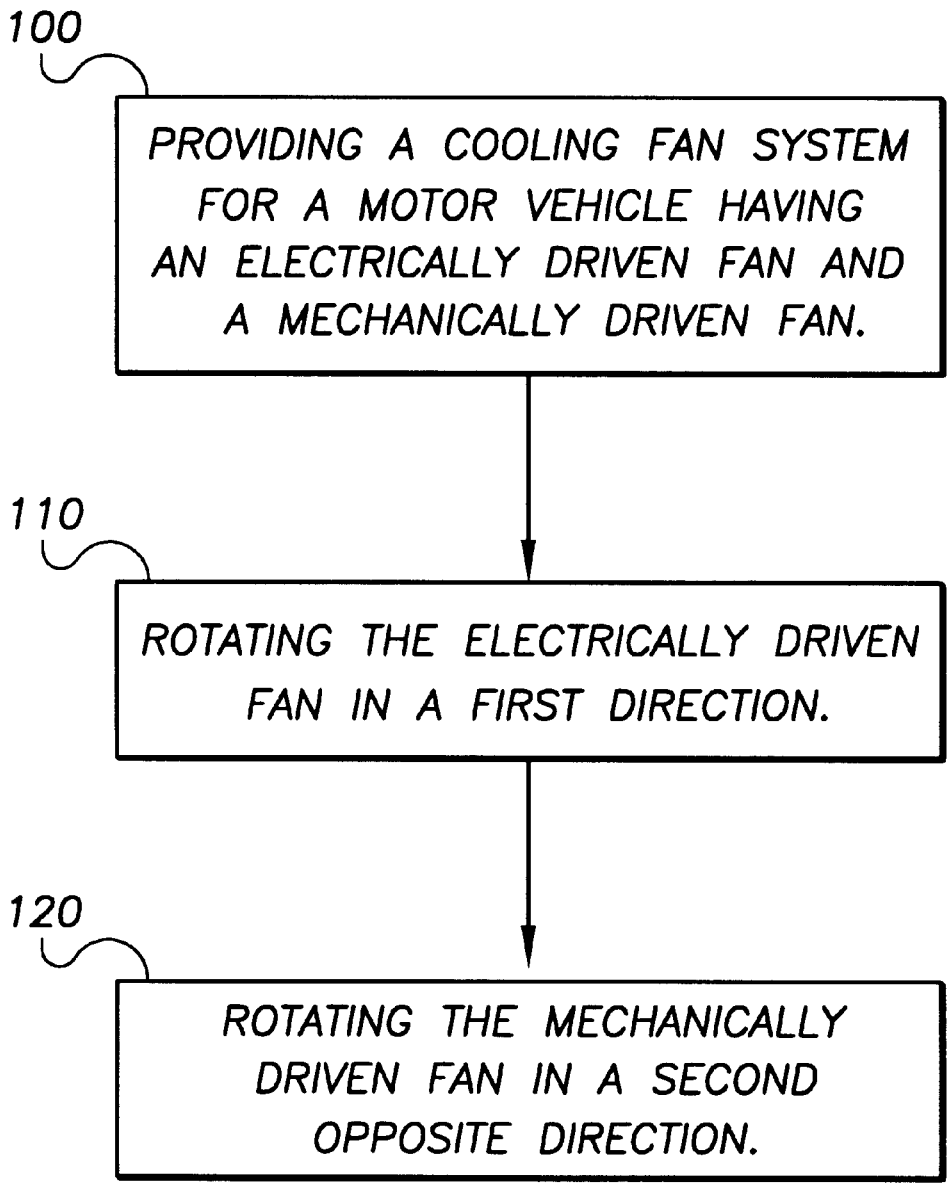
FIG. 6 is a flow diagram illustrating the general steps of a method of the present invention.

With reference to FIG. 6, the general steps of a preferred method of the present invention are set forth. In a first general step 100, a cooling fan system 10 such as that described herein is provided having an electrically driven fan 18 and a mechanically driven fan 16. In a second general step 110, the electrically driven fan 18 is rotated in a first direction. In a third general step 120, the mechanically driven fan 16 is rotated in a second direction which is counter to the rotation of fan 18 in said first direction.

Thus, it will now be understood that an improved cooling fan system is provided by the present invention. Advantages provided by the present invention include, but are not limited to, fuel economy improvement, an ability to reduce pulley ratio of the A/C compressor which results in noise and warranty improvements, reduced noise at idle and low speeds, reduced ANC head pressures throughout the working range of the vehicle which results in lower interior temperatures and improved A/C warranty, reduced radiator top tank temperature, and reduced under hood temperatures.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A cooling fan system for a motor vehicle having an engine and a radiator, the cooling fan system comprising:

a first fan adapted to be disposed between the engine and the radiator, said first fan adapted to rotate in a first direction; and a second fan adapted to be disposed between the engine and the radiator, said second fan disposed in series with said first fan and adapted to rotate in a second direction, said second direction being counter to said first direction;

said first fan mounted for rotation about a first axis of rotation and said second fan mounted for rotation about a second axis of rotation, said first axis of rotation being spaced from said second axis of rotation.

2. The cooling fan system for a motor vehicle of claim 1, wherein said second fan is disposed aft of said first fan.

3. The cooling fan system for a motor vehicle of claim 1, wherein said first fan is configured to generate a substantially axially directed air flow.

4. The cooling fan system for a motor vehicle of claim 3, wherein said second fan is configured to generate a substantially radially directed air flow.

5. The cooling fan system for a motor vehicle of claim 1, wherein said second fan is driven by said engine.

6. The cooling fan system for a motor vehicle having an engine and a radiator of claim 1, further comprising a shroud radially surrounding said first fan and said second fan for directing a source of air flow between said second fan and said first fan, said shroud being upwardly angled toward said engine.

7. A cooling fan system for a motor vehicle having an engine and a radiator, the cooling fan system comprising:

an electrically driven fan adapted to be disposed between the engine and the radiator, said electrically driven fan adapted to rotate in a first direction; and a mechanically driven fan adapted to be disposed between the engine and the radiator, said mechanically driven fan disposed in series with said electrically driven fan and adapted to rotate in a second direction, said second direction being counter to said first direction;

wherein said electrically driven fan is configured to generate a substantially axially directed flow and said mechanically driven fan is configured to generate a substantially radially directed flow.

8. The cooling fan system for a motor vehicle of claim 7, wherein said mechanically driven fan is disposed aft of said electrically driven fan.

9. The cooling fan system for a motor vehicle of claim 7, wherein said electrically driven fan is mounted for rotation about a first axis of rotation and said mechanically driven fan is mounted for rotation about a second axis of rotation, said first axis of rotation being spaced from said second axis of rotation.

10. The cooling fan system for a motor vehicle of claim 7, wherein said mechanically driven fan is driven by said engine.

11. The cooling fan system for a motor vehicle having an engine and a radiator of claim 7, further comprising a shroud radially surrounding said first fan and said second fan for directing a source of air flow between said second fan and said first fan, said shroud being upwardly angled toward said engine .

12. A motor vehicle comprising:

an engine capable of operating at various rotational speeds;

a radiator mounted fore of said engine; and a cooling fan system including an electrically driven fan and a mechanically driven fan;

a clutch coupling said engine to said mechanically driven fan, said clutch capable of allowing said mechanically driven fan to operate at a rotational speed substantially less than said rotational speed of said engine while said rotational speed of said engine is less than 4000 revolutions per minute;

said electrically driven fan disposed between the engine and the radiator, said electrically driven fan adapted to rotate in a first direction;

said mechanically driven fan disposed between the engine and the radiator in series with said electrically driven fan, said mechanically driven fan and adapted to rotate in a second direction, said second direction being counter to said first direction;

said electrically driven fan mounted for rotation about a first axis of rotation and said mechanically driven fan mounted for rotation about a second axis of rotation, said first axis of rotation being spaced from said second axis of rotation.

13. The motor vehicle for a motor vehicle of claim 12, wherein said mechanically driven fan is disposed aft of said electrically driven fan.

14. The motor vehicle for a motor vehicle of claim 12, wherein said electrically driven fan is configured to generate a substantially axially directed air flow.

15. The motor vehicle for a motor vehicle of claim 14, wherein said mechanically driven fan is configured to generate a substantially radially directed air flow.

16. The motor vehicle for a motor vehicle of claim 12, further comprising a thermocouple mounted on said mechanically driven fan, wherein said mechanically driven fan is capable of revolving at speeds substantially equal to the rotational speed of the engine while said thermocouple reads an air temperature higher than a predetermined air temperature.

17. The motor vehicle for a motor vehicle of claim 12, wherein said predetermined air temperature is 200 degrees Fahrenheit.

18. The motor vehicle of claim 12, further comprising a shroud radially surrounding said first fan and said second fan for directing a source of air flow between said second fan and said first fan, said shroud being upwardly angled toward said engine.

* * * * *